United States Patent [19]

Washington, Jr.

[11] 4,391,368

[45] Jul. 5, 1983

[54] PACKAGING AND DISPENSING SYSTEM

[76] Inventor: Leroy Washington, Jr., 143 Ironwood Cir., Sierra Vista, Ariz. 85635

[21] Appl. No.: 252,301

[22] Filed: Apr. 9, 1981

[51] Int. Cl.[3] ..... B65D 83/00; B65D 33/00

[52] U.S. Cl. ..... 206/484; 206/539; 206/820; 206/634; 222/107

[58] Field of Search ..... 206/484, 539, 820, 634; 220/307; 222/107

[56] References Cited

U.S. PATENT DOCUMENTS

| | | | |
|---|---|---|---|
| 2,443,425 | 6/1948 | Iverson | 732/84 |
| 2,808,926 | 10/1957 | Drake et al. | 222/107 |
| 3,146,912 | 9/1964 | Twersky | 222/107 |
| 3,221,939 | 12/1965 | Brown | 222/107 |
| 3,446,632 | 5/1969 | Le Van | 206/484 |
| 3,453,661 | 7/1969 | Repko | 206/484 |
| 3,664,541 | 5/1972 | Ruskin | 220/307 |

*Primary Examiner*—William T. Dixson, Jr.
*Attorney, Agent, or Firm*—John F. McClellan, Sr.

[57] ABSTRACT

A system for containing and dispensing flowable substances includes a plurality of discrete containers associated by a common web; each container has a respective openable closure sealing the contents in; special provisions of the invention provide for opening by ripping tab in a manner promoting spreading of the contents, or by a plug, affording choice different size openings either predeterminable or enlargeable as required, depending on embodiment; the containers can be left in association after use or can be separated prior to or during use, as desired; compact carrying provision is disclosed along with an instant visual inventory aspect.

1 Claim, 7 Drawing Figures

PACKAGING AND DISPENSING SYSTEM

FIELD OF THE INVENTION

This invention relates generally to packaging and dispensing and specifically to packaging in a plurality of related but discrete containers.

A PRINCIPAL OBJECT OF THE INVENTION

A principal object of this invention is to provide a packaging and dispensing system for flowable materials which may replace existing systems and may become the standard of the industry.

PRIOR ART

In the prior art U.S. Pat. No. 2,443,425 issued to W. A. Iverson on June 15, 1948 discloses a plurality of associated capsules holding discrete quantities of dentrifice.

FURTHER OBJECTS OF THE INVENTION

In accordance with the specification herein, further objects of the invention are to provide a system as described which:

holds and dispenses premeasured amounts of flowable material of many types, in most convenient and economical modes, fresh and free from spoilage by exposure to air, dispensing with gross reuse-tubes and the like;

opens on tab pull upward, which is positive and easy to open, in embodiments of which the tab can be left on or torn off:

which can be opened with one hand, and which offers in a preferred embodiment a choice of predeterminable opening sizes, but is substantially spill-proof and has provision protecting against contents spillage from overheating or freezing;

which presents the user with clear access to an array of individually openable flexible plastic compartments aligned as desired so that the contents of one or of several together can be used;

which affords the user a choice of keeping together the various compartments before, during and after use, or of separating one or more of them before, during, or after use, as desired; customarily, for example, the user might select one unit, separate it, open it, express the contents for use and discard the spent unit;

which presents a uniform, easily accessible compartment shape accessible from both sides to pinching or other manipulation for expressing the contents cleanly and efficiently;

which can be produced in infinitely long arrays in continuous production, and cut to length and width as required; for example, sheets containing 32 units can be packaged in boxes of 4, 8 or 12 sheets for bathroom, medicine chest storage or carrying;

which is self-inventorying in that the used and the full compartments can be identified at a glance;

which is attractive in appearance, easy and safe to use, is lightweight but tough, takes up little space, and can be arranged in various desired patterns and relations suited to special needs;

and which for personal hygiene uses is ideally adapted for use in travel, office, locker room, hotel, motel, hospital, sick bed, dormitory, school, dental clinic, home or purse carrying.

BRIEF SUMMARY OF THE INVENTION

In brief summary given as cursive description only and not as limitation, the invention includes a plurality of individually openable flexible compartments held in array on a flexible web.

BRIEF DESCRIPTION OF THE DRAWINGS

The above and other objects and advantages of this invention will become more readily apparent from examination of the following description, including the drawing figures, in which like characters denote like parts.

DETAILED DESCRIPTION OF THE DRAWINGS

Figure 1:
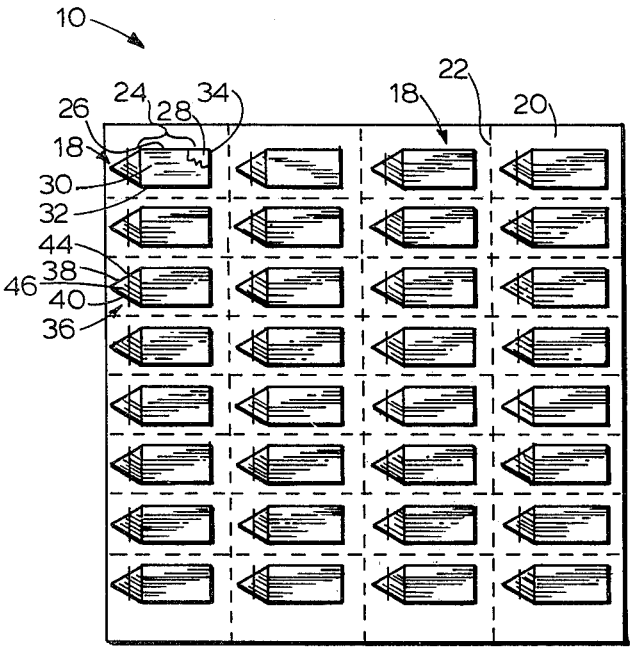
FIG. 1 is a plan view of a first embodiment array of containers with associative web.
Figure 2:
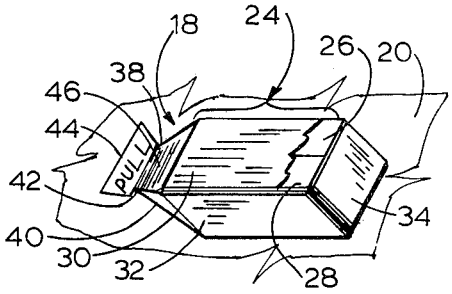
FIG. 2 is a fragmentary perspective detail of a container thereof, including a portion of the web.

FIGS. 1 and 2 show the invention in embodiment 10 as comprising a spaced-apart plurality of containers 18 associated by a web 20 which forms a common base for all containers. The containers may be in regular array as shown, spaced apart in a predetermined pattern.

The web may have a grid of perforations 22 isolating the respective containers. These two provisions are means providing for the containers to be individually torn or cut free with a part of the web before, after or during use, if desired.

Each container has a body 24 substantially in the shape of a parallelopiped with first and second ends, and with sides 26, 28, 30, 32 joined by the second end or rectangular end 34.

The openable end or first end 36 is in the shape of a pyramid with first and second inclined panels or sides 38, 40, tapering to a point 42 defined by assymmetrical incline of the third inclined side to juncture with the web.

For opening the containers, a respective full-width tab 44 extends from each third inclined side 46, intermediate the length thereof, in an upward direction generally in a parallel plane with the second end 34. Scored lines may be used to guide the tear in conventional manner.

To produce a predeterminable full width opening the tab 44 can be pulled upwardly toward the body 18, progressively opening the third inclined side 46 for most of the length and to full width where it joins the body, as for evenly spreading toothpaste on a brush. The tab can help with this.

It is evident that to produce a predeterminable smaller size opening, if desired, the user has merely to pull the tab 44 away from the body or toward the point. The tab can be pulled and the container constrained using only one hand if necessary, by pulling the tab with a rolling motion of the hand which at the same time lies on the array and holds it against a table, a wall, or the like. In any case, the opening process is easy because the tab 44 which is molded or otherwise conventionally fabricated or cemented integral with the third inclined side 46 has only to break free a narrow width of the third inclined side at the point of rupture. The tab normally can remain connected with the container for convenience in disposal or can be torn away if desired. In proportion, the tab may be wider at the free end than at the attached end for ease in grasping.

To expel the contents of a container when opened, the container may be squeezed between thumb and forefinger, easily and quickly emptying it, regardless of whether attached to or separated from the array. If desired, the web may be creased and folded along a line of perforation to clear a rank of containers for expulsion past the rank in front, or for lateral clearance for access to a difficult location. Because of the regular proximity of containers, it is evident that plural containers can be opened and then can be emptied at one time by application of pressure approximately. Position of the tab tells by sight or feel instantly whether a particular container is full or empty.

It will be evident that almost any flowable material compatible with conventionally moldable or free formed and heat sealable flexible plastic such as polyvinyl chloride or the like, or with aluminum foil as the case may be, depending on composition of the containers, can be contained, toothpaste in 0.5 cc or one-brushing quantity per container being an example; pharmaceuticals, epoxy cements and resins, foods, lubricants, cosmetics, gels, cleaners, artists paints, and the like being others. For example, amylnitrate currently is contained in fibreglass pellets, but it can as well be packaged in an aluminum capsule according to this invention. Volatiles can be packaged in vinyl capsules according to this invention. The container wall-thickness can range from a fraction of a millimeter upward. If of plastic, the walls may be transparent for contents-visibility or opaque for contents-protection from sunlight, and in any case may be colored for ready identification and attractive appearance. Any material of the classes mentioned and many others up to perhaps 2.5 cc volume can easily be contained and used.

It is evident that expansion of contents from heat or cold may be prevented from rupturing the sanitarily sealed containers by bulging of the flat sides, increasing the capacity in response to pressure by tending towards more spherical shape; the spacings between the respective containers are means permitting this. If the sides were rounded they would tend to rupture instead of bulging and containing, when under excess pressure with a full load of incompressible material.

The plastic base may have an adhesive layer for attacking the aluminum, or may heat seal to it.

As an alternative provision the form of the array may be the same but the plastic base may be integrally molded with plastic bodies.

Size for the toothpaste containing array may be $3\frac{1}{2}$ inches (8.8 cm) by $3\frac{3}{8}$ inches (8.4 cm) with container bodies $\frac{1}{2}$ inch (1.3 cm) long by $\frac{1}{4}$ inch (0.6 cm) wide by 3/16 inch (0.47 cm) deep. The aluminum foil container may be a fraction of a millimeter thick; the bottom can, if desired, be of aluminum foil, somewhat thicker preferably.

Figure 3:
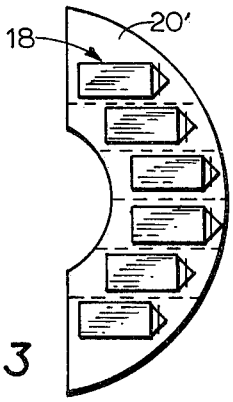
FIG. 3 is a plan view for an alternative embodiment array of said containers.

FIG. 3 shows a plurality of containers 18 disposed in arcuate array on an arc-shaped web 20', indicating the versatility of the design.

Figure 4:
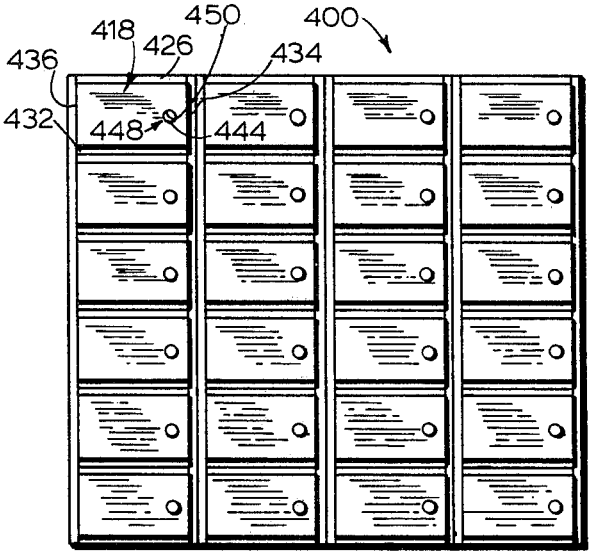
FIG. 4 is a plan view of a further embodiment of containers.

FIG. 4 shows a further embodiment 400 of the invention in which the containers 418 are rectangular in plan, each with upright first end 436 and second end 434, sloped lateral sides 426 and 432, in a free-formed vinyl package or container. The vinyl may be 18 gauge heat-set preformed sheet in accordance with well known practice. The containers may be $\frac{1}{2}$ inch (1.3 cm) by $\frac{7}{8}$ inch (2.1 cm) by sufficient thickness to provide 0.5 cc capacity. The containers may nearly abut on all sides. This makes the array compact and especially suited for carrying in pocket or purse.

Each container is sealed by a respective openable or detachable plug 448 on the longitudinal centerline near one end or first end. The stem 444 of the plug may be supported by extending upward through a hole 450 in the container which it fits, and forms a grasping handle for pulling the plug out and opening the container.

Figure 5:
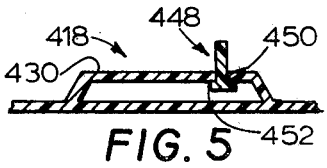
FIG. 5 is an elevational sectional detail of one container thereof.

FIG. 5 shows sealing by the plug 448. An adhesively sealed (or heat sealed) enlargement or surrounding head 452 on the lower end of the stem adhering to the lower side of the top side 430 of the container 418, seals the opening 450.

To open, the user pulls on the stem and rips open the container; pulling straight up produces a small hole; pulling to side or end produces a larger hole, as the head 452 ruptures the top side 430. Accidental opening by side pressure is guarded against by the means of having the head inside with the hole supporting the stem.

Figure 6:
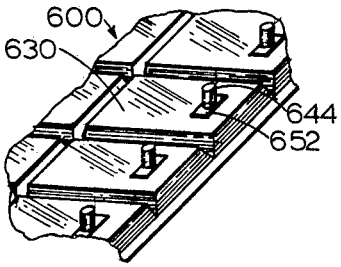
FIG. 6 is a perspective detail of containers similar to those of FIG. 4 but with an alternative mode of closure.
Figure 7:
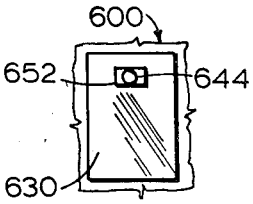
FIG. 7 is a plan view of one of the FIG. 6 containers.

FIGS. 6 and 7 show similar embodiment 600 in which the head 652 is adhered to the upper surface of the top side 630 of each container. This can produce a dependable uniform opening when pulled free by stem 644 without rupture of the top, and may be easier to open.

This invention is not to be construed as limited to the particular forms disclosed herein, since these are to be regarded as illustrative rather than restrictive. It is, therefore, to be understood that the invention may be practiced within the scope of the claims otherwise than as specifically described.

What is claimed and desired to be protected by United States Letters Patent:

1. A system for packaging and distributing predetermined increments of flowable material, comprising: a web, a plurality of discrete containers on said web in a predetermined pattern, means for opening each container individually, means providing for separation of one or more containers with a part of said web from the remainder of said containers and web, said means for opening providing for opening to either one of two predetermined sizes of opening depending on direction of opening by said means for opening, said means for opening including a tapered side with widening and narrowing portions on said container, and a pull-tab affixed across said tapered side at a location intermediate the length of said tapered side in position for being pulled in a direction producing a widening opening by breaking free said widening portion of said tapered side when pulled toward said widening portion of said tapered side, and alternatively for being pulled in a direction producing a narrowing opening by breaking free said narrowing portion of said tapered side when pulled toward said narrowing portion of said tapered side.

* * * * *